US011525570B2

(12) United States Patent
Hurylski et al.

(10) Patent No.: US 11,525,570 B2
(45) Date of Patent: Dec. 13, 2022

(54) TEALIGHT CUP

(71) Applicant: KORONA CANDLES Sp. z o. o., Wielun (PL)

(72) Inventors: Marcin Hurylski, Wielun (PL); Jaroslaw Pawel Wolowiec, Wierzchlas (PL); Roman Kotala, Wielun (PL); Robert Bieganski, Wielun (PL); Artur Soja, Wielun (PL); Krzysztof Tomanik, Wielun (PL); Monika Zawadzka, Mokrsko (PL); Andrzej Wrobel, Wielun (PL)

(73) Assignee: KORONA CANDLES SP. Z O. O., Wielun (PL)

( * ) Notice: Subject to any disclaimer, the term of this patent is extended or adjusted under 35 U.S.C. 154(b) by 381 days.

(21) Appl. No.: 16/779,722

(22) Filed: Feb. 3, 2020

(65) Prior Publication Data

US 2020/0173647 A1 Jun. 4, 2020

Related U.S. Application Data

(63) Continuation-in-part of application No. 15/302,172, filed as application No. PCT/EP2015/057564 on Apr. 8, 2015, now Pat. No. 10,563,860.

(30) Foreign Application Priority Data

Apr. 9, 2014 (EP) ..... 14461524

(51) Int. Cl.
*F21V 35/00* (2006.01)
*C11C 5/00* (2006.01)

(52) U.S. Cl.
CPC ..... *F21V 35/00* (2013.01); *C11C 5/00* (2013.01)

(58) Field of Classification Search
None
See application file for complete search history.

(56) References Cited

U.S. PATENT DOCUMENTS 10,563,860 B2 * 2/2020 Hurylski ..... F21V 35/00

FOREIGN PATENT DOCUMENTS

| | | | | |
|---|---|---|---|---|
| DE | 19548958 01 | * 12/1996 | ..... | C11C 5/008 |
| DE | 202010001384 U1 | * 4/2010 | ..... | F21V 35/00 |
| WO | WO 2008061293 A1 | * 5/2008 | ..... | F21V 35/00 |
| WO | WO 2010064941 A2 | * 6/2010 | ..... | F21V 35/00 |

OTHER PUBLICATIONS

Fritz Pfeuffer, Wax light in the metal cup (Year: 2010).*

* cited by examiner

*Primary Examiner* — Jason Lau
(74) *Attorney, Agent, or Firm* — Mark M. Friedman

(57) ABSTRACT

A tealight cup for holding a combustible candle has a a side wall, a base with a flat central area, at least two bulges positioned around the flat central area, wherein the bulges have a height (h) of at least 10% of the height (H) of the side wall and are positioned around the flat central area circumferentially along a common circumference and have a total volume equal to at least 10% of the volume of the part of the cup from the base to the height (h) of the bulges.

1 Claim, 9 Drawing Sheets

TEALIGHT CUP

TECHNICAL FIELD

The object of the present invention is a tealight cup.

BACKGROUND

There are known tealights provided in cups made of heat conductive material, such as metal (for example aluminum) or metal alloy, having a shape of a cylinder, wherein the diameter of a circular base is greater than the height of a sidewall. The cup serves as a bowl for a flammable mass, which melts and decreases its volume as it is combusted, until the whole melted mass is combusted, when the flame stops.

An PCT patent application WO2010064941 presents a tealight cup, in which a base has a formed groove along its edge and a central depression connected with three radially formed grooves. The angle between the bottom edge of the grooves and the horizontal level and the angle between the base plane and the horizontal level is between 0 and 60 degrees. The radial grooves serve to guide the flammable mass from the outer edge of the base to the central depression where a wick is secured. The groove is relatively shallow (its depth equals about 5% of the total height of the cup). If the angle of groove inclination were to be increased, this would result in the increase of the angle of the base plane. Therefore, for increased inclination angles, the bottom has a shape of a cone which is convex outwardly, which facilitates flow of melted flammable mass towards the wick.

A German patent document DE19548958 presents a structure of a tealight cup, which allows more efficient use of the flammable mass. The cup has a central cavity connected with shallow radial channels (having depth equal to about 8% of the total height of the cup) formed in the bottom. The radial channels do not extend to the outer edge of the base of the cup.

A PCT patent application WO0139407 discloses a tealight cup having conical side walls and a bottom with small depressions forming legs of the cup, as well as a circumferential groove.

A U.S. Pat. No. 7,247,017 discloses a construction of a tealight cup allowing a more efficient use of flammable mass. The cup comprises a convex perforated cap having a shape complementary to a recess formed centrally in the bottom of the cup. The cap and the recess are shaped so that, between the surface of the cap and the recess there is formed a capillary gap, through which the melted flammable mass flows towards a wick.

A US patent application US2007275336A1 discloses a candle holder with thin stubs formed in the bottom of the holder for preventing the candlewick and its supporting plate from moving horizontally when the solid fuel is melting.

A U.S. Pat. No. 6,033,209 discloses a melody candle assembly, wherein a candle has a bottom cap with two recesses formed around different circumferences around the central area of the cap in order to allow selection of different switches of a candlestick in order to select a melody to be played.

The construction of tealights candleholders depends mainly on their function and aesthetic properties. For example, a candleholder for tealights may form a set with a teapot for making tea—in such case the candleholder has a form of a bowl on which the teapot is positioned. Fancy shapes of candleholders do not always allow for permanent mount of a tealight, especially when its base surface, on which the tealight is positioned, is not flat.

This may cause tilt of tealights with respect to a horizontal level, for example when the tealight is not positioned horizontally or when the candleholder is displaced. In addition, even if the candleholder allows for precise positioning of the tealight within the candleholder, the candleholder itself may be tilted—for example, when it is positioned on an uneven surface, for example a tabletop of a table positioned in a garden or on an inclined window sill. In such a case, the melted flammable mass of the tealight will concentrate mainly in the lowest part of the cup. This may cause loss of contact between the wick and the flammable mass leading to early extinguishing of the flame. As a consequence, an inclined tealight will burn out more quickly than a tealight positioned horizontally and having the same structure of the cup, due to the fact that part of the flammable mass—concentrated in the lowest point of the inclined tealight—will remain unburnt.

There is therefore a need to provide a tealight cup, which will allow efficient use of flammable mass even in case when the tealight burns in an inclined position.

SUMMARY

There is disclosed a tealight cup comprising a side wall and a base with a flat central area and at least two bulges positioned around the flat central area and having a height (h) of at least 10% of the height (H) of the side wall. The bulges are positioned around the flat central area circumferentially along a common circumference and have a total volume equal to at least 10% of the volume of the part of the cup from the base to the height (h) of the bulges.

The bulges may have substantially the same shape.

The bulges may have different shapes.

The bulges may have a convex side wall.

Between the bulges there are formed radial grooves connecting the outer edge of the base with the central area.

Around the outer edge of the base there is formed a circumferential groove.

BRIEF DESCRIPTION OF DRAWINGS

The object of the invention has been presented in an exemplary embodiment on a drawing in which.

DETAILED DESCRIPTION

Figure 6B:
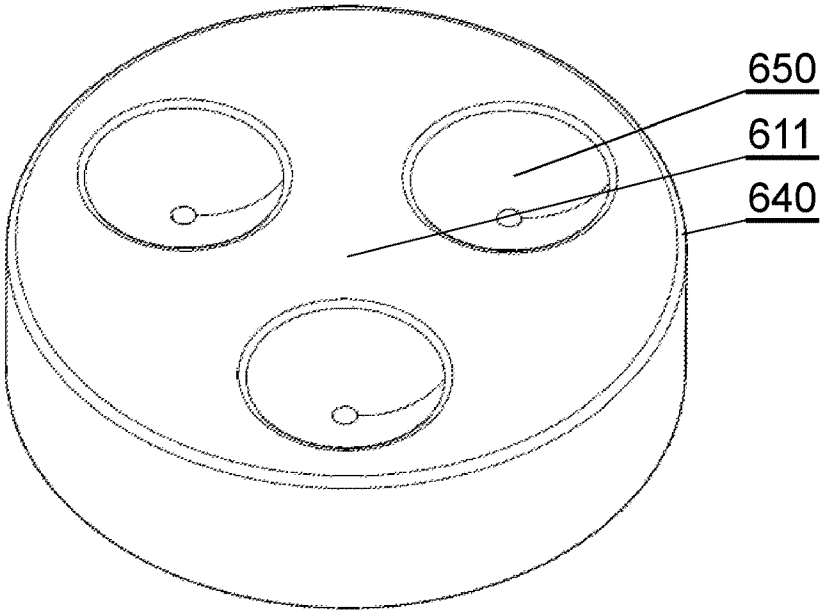
FIG. 6A, 6B show a tealight cup in a sixth embodiment having three similar bulges in a tilted top a bottom view, respectively.
Figure 6A:
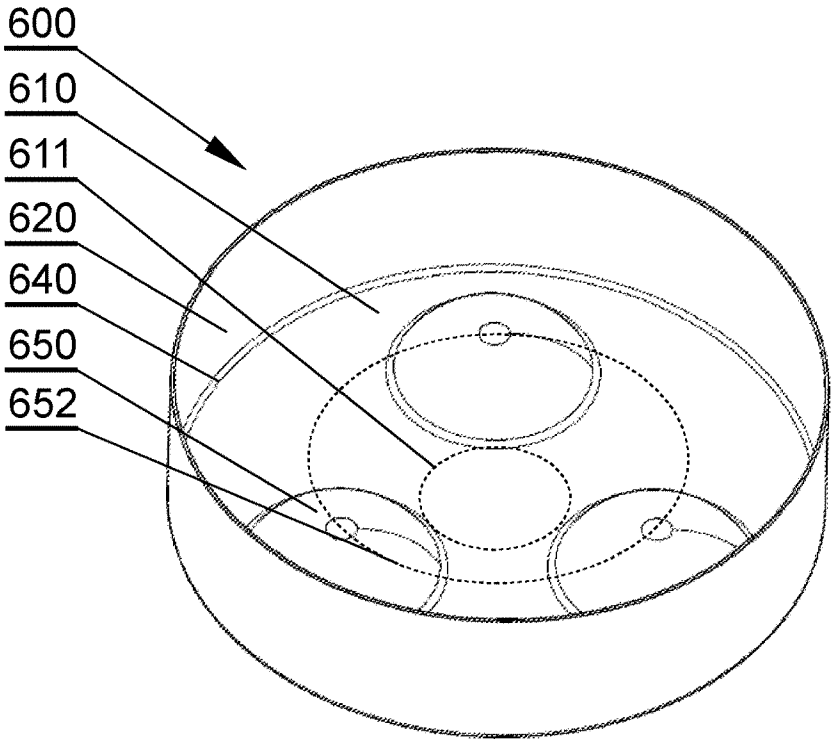
Figure 7B:
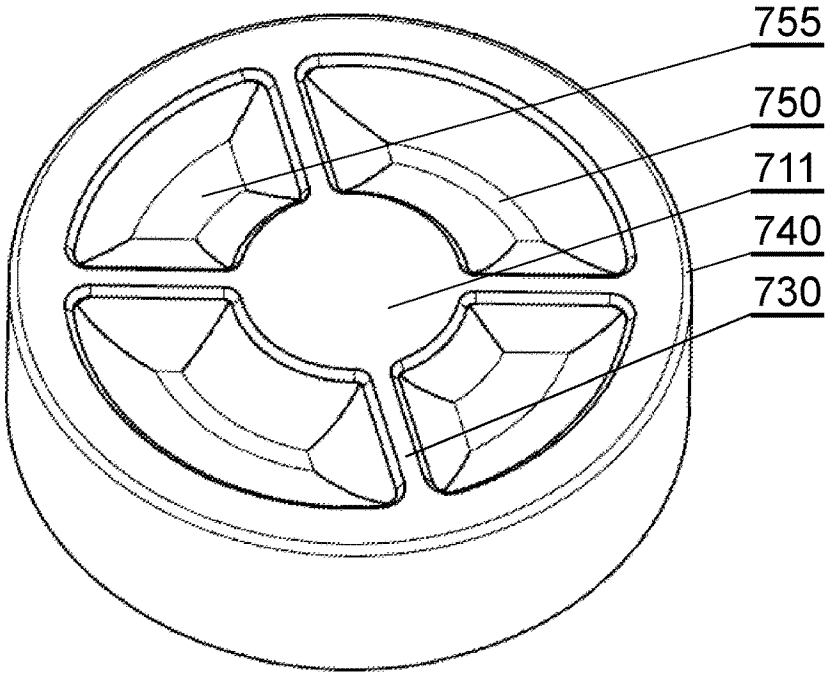
FIG. 7A, 7B show a tealight cup in a seventh embodiment having four dissimilar bulges in a tilted top a bottom view, respectively.
Figure 7A:
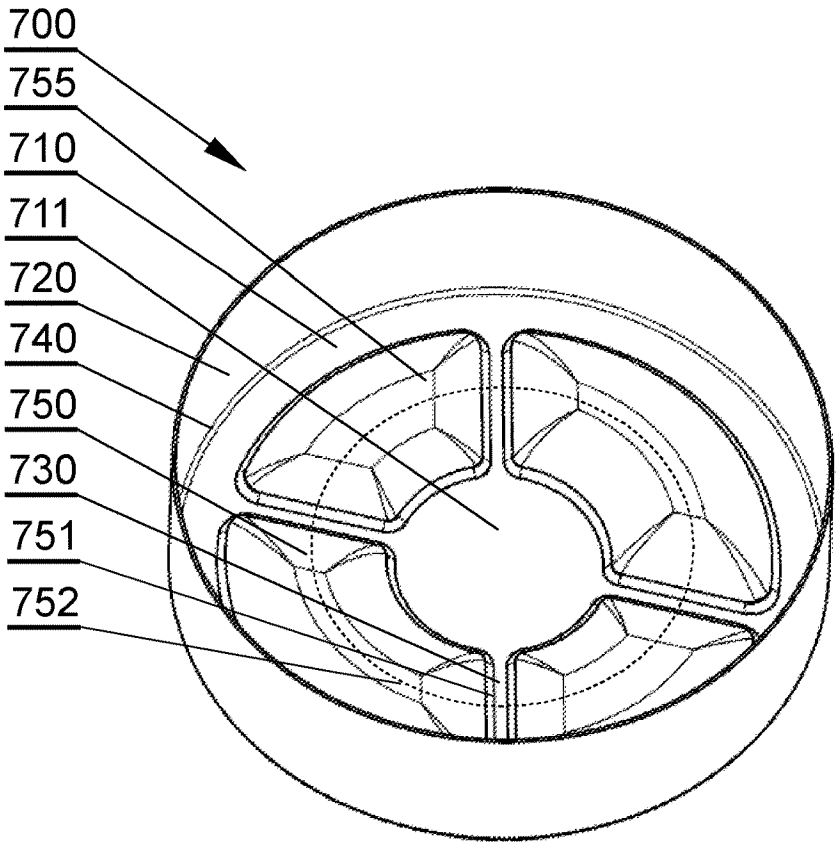
Figure 8:
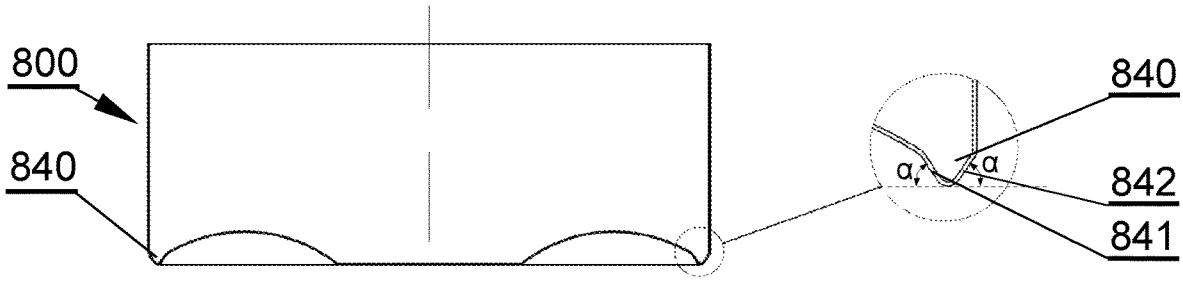
FIG. 8 shows a tealight cup in an eighth embodiment.
Figure 9:
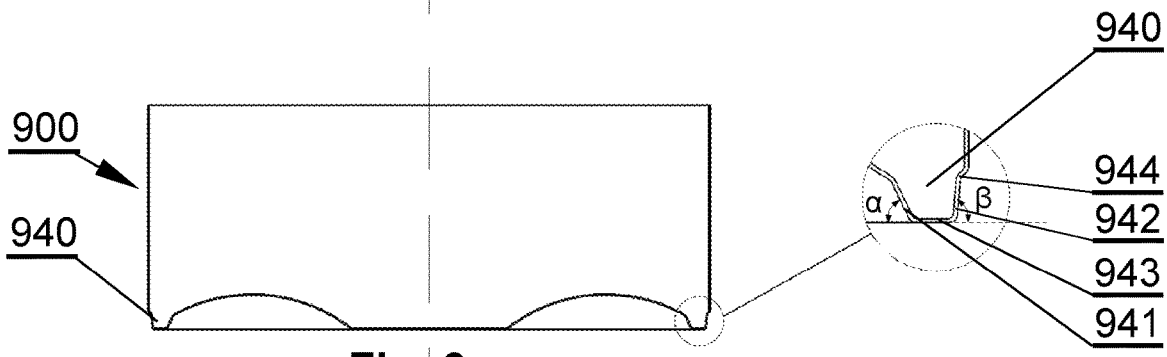
FIG. 9 shows a tealight cup in an ninth embodiment.
Figure 10:
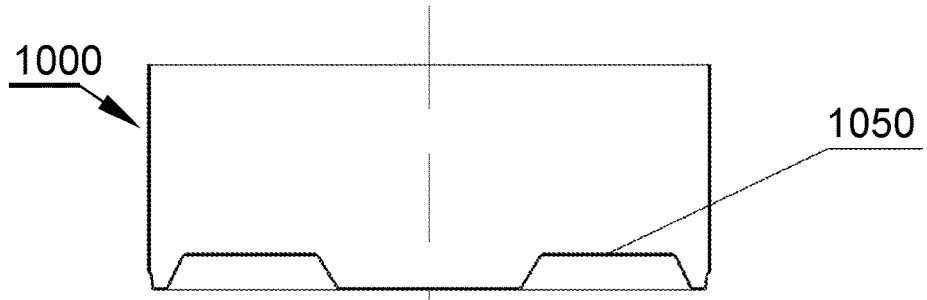
FIG. 10 shows a tealight cup in an tenth embodiment.

FIGS. 1-10 show various embodiments of tealight cups 100-1000, wherein in FIGS. 1-7 FIG. A shows the cup in a tilted top view and FIG. B shows the cup in a tilted bottom view, and in FIGS. 8-10 a cross-section of the cup is shown.

Figure 1B:
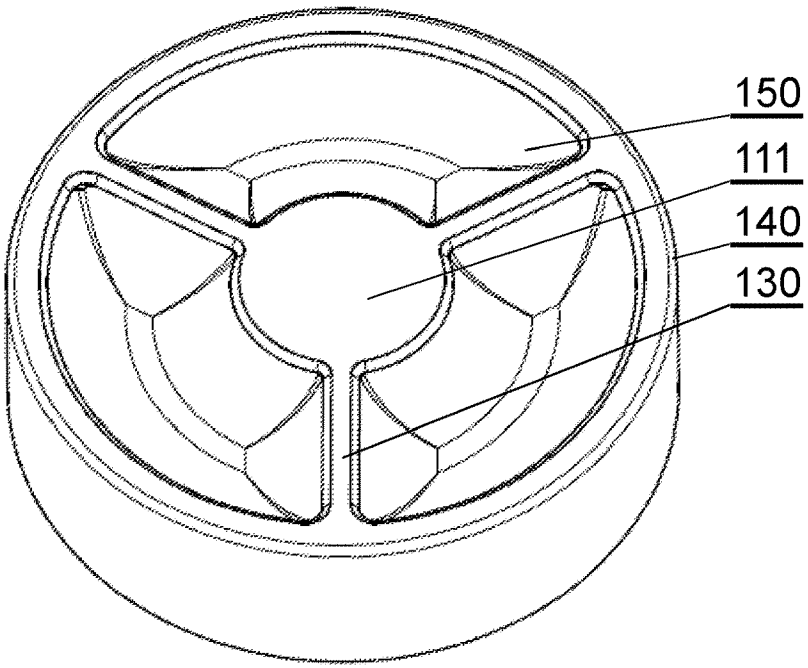
FIG. 1A, 1B show a tealight cup in a first embodiment having three similar bulges in a tilted top a bottom view, respectively.
Figure 1A:
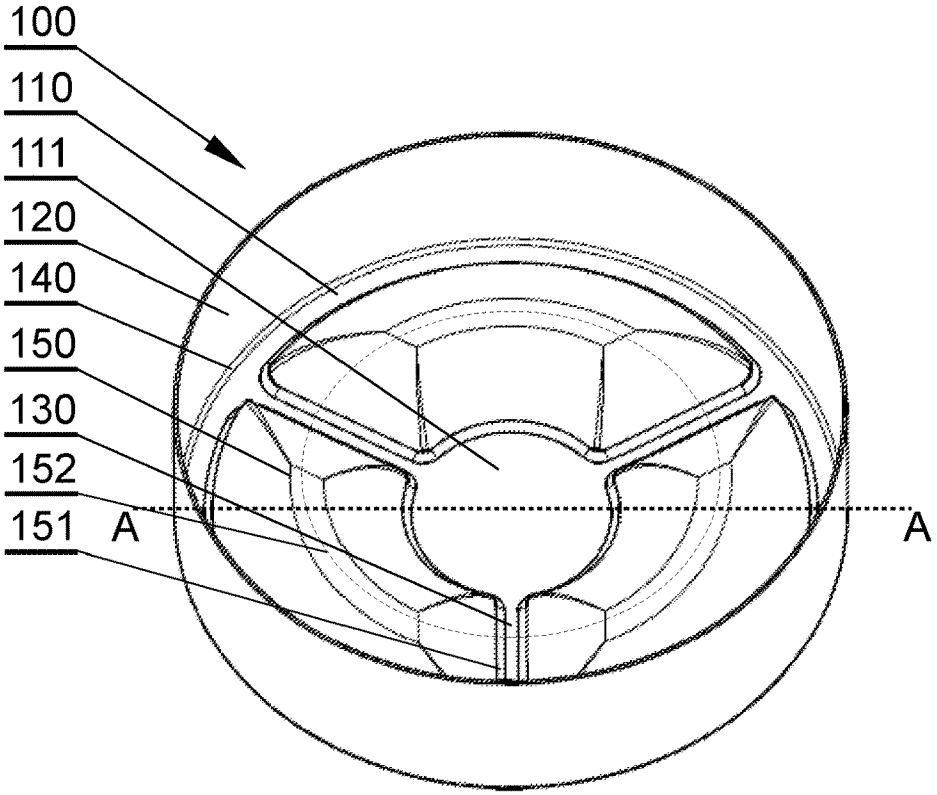
Figure 2B:
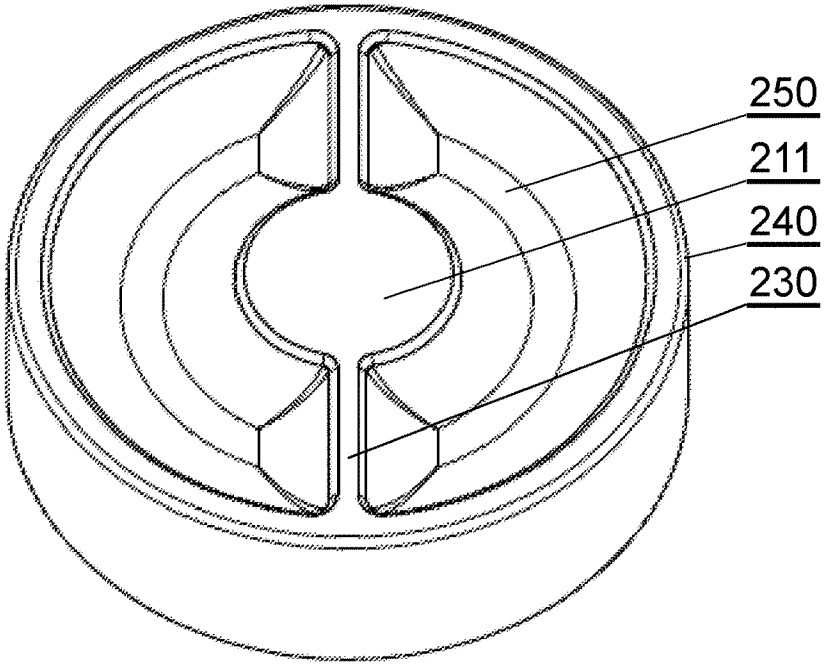
FIG. 2A, 2B show a tealight cup in a second embodiment having two similar bulges in a tilted top a bottom view, respectively.
Figure 2A:
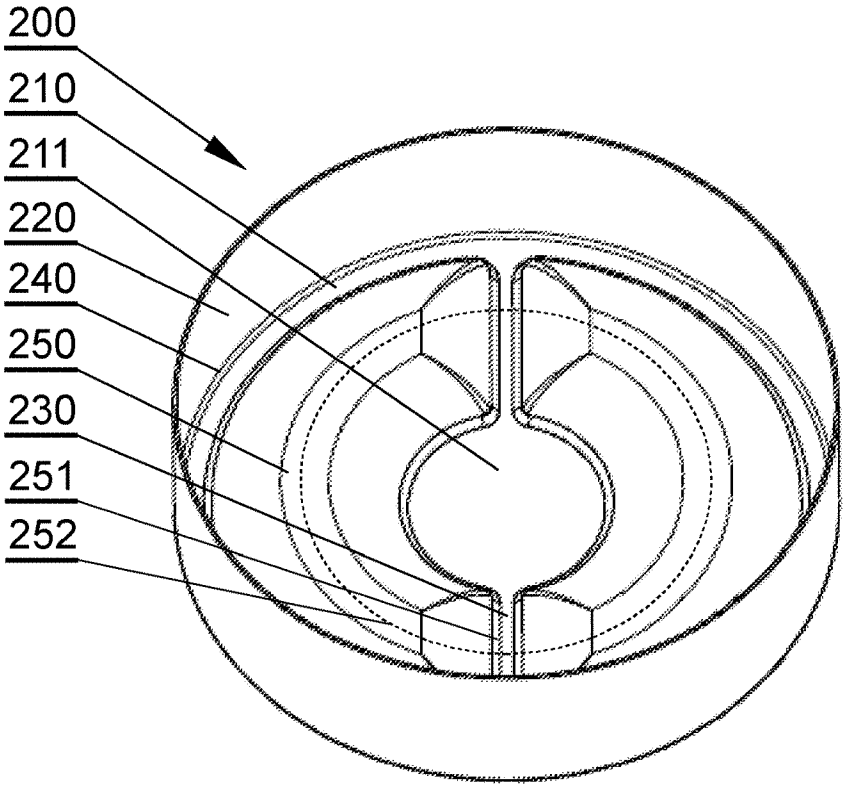
Figure 3B:
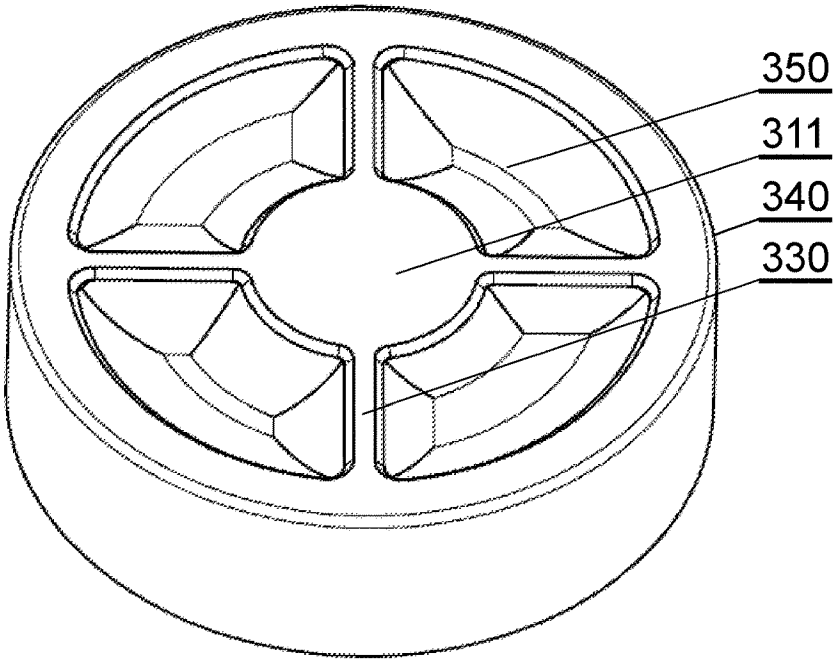
FIG. 3A, 3B show a tealight cup in a third embodiment having four similar bulges in a tilted top a bottom view, respectively.
Figure 3A:
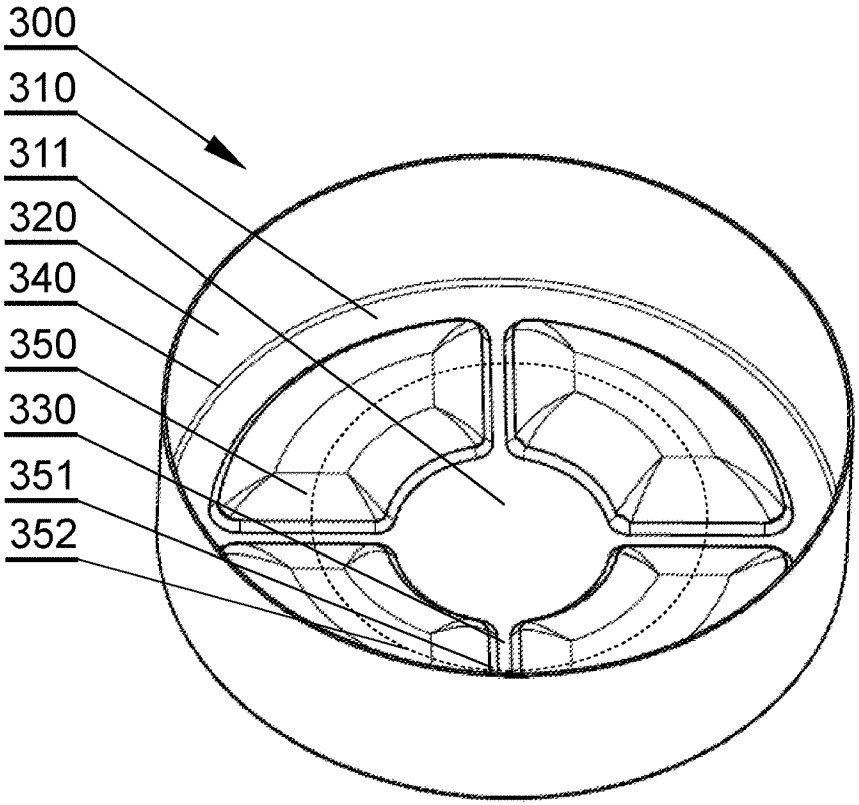
Figure 4B:
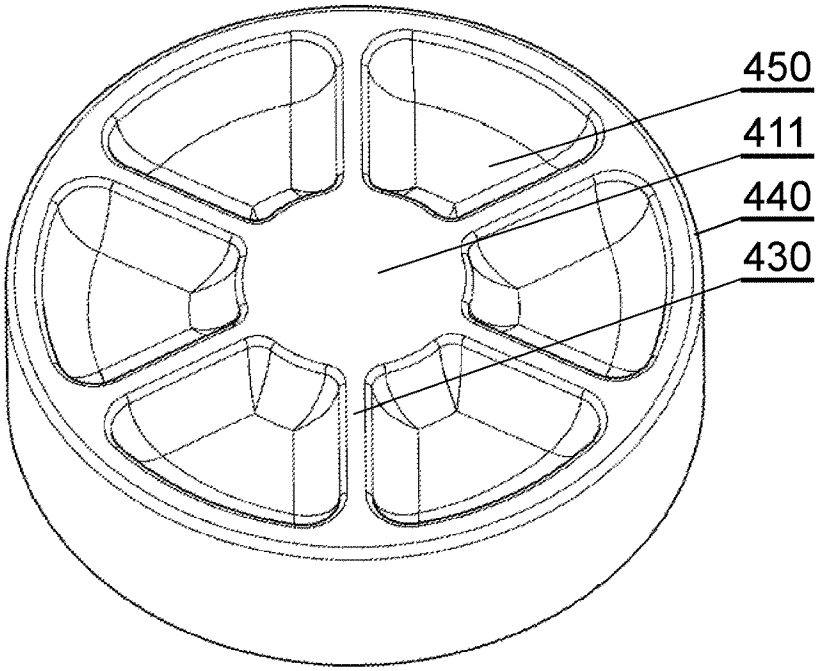
FIG. 4A, 4B show a tealight cup in a fourth embodiment having six similar bulges in a tilted top a bottom view, respectively.
Figure 4A:
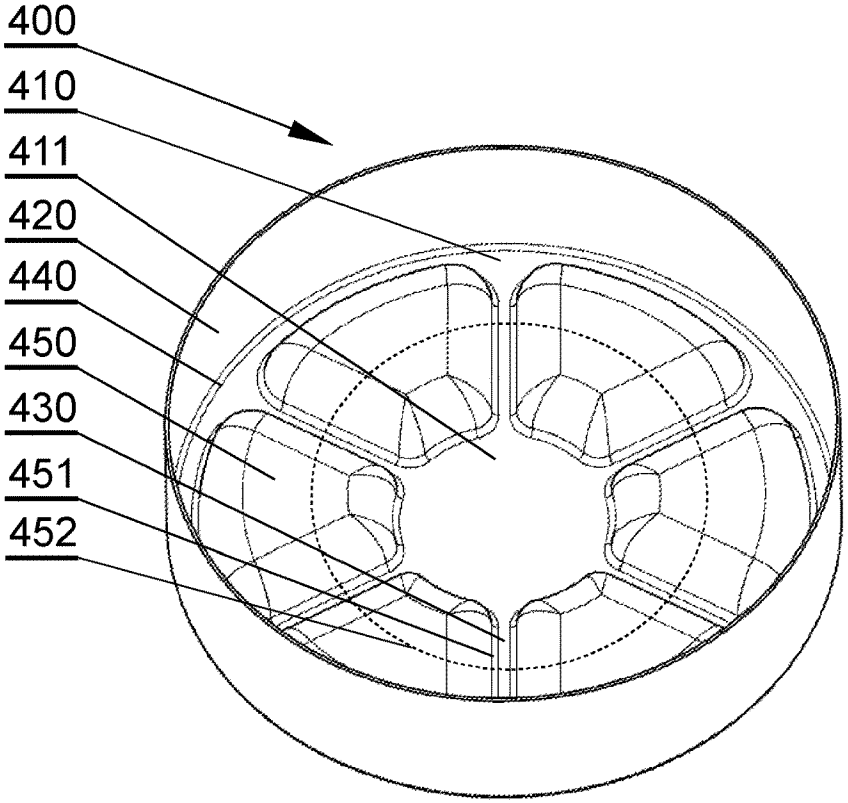

As shown in the first embodiment on FIGS. 1A-1B, the (preferably cylindrical) cup 100 has a base 110, preferably circular, and a side wall 120 having a shape of side wall of a cylinder.

The circular base 110 of the cup 100 has a flat central area 111. The central area 111 is the area including the central point of the circular base and limited by the internal sides of the bulges 150, i.e. the sides which face the central point of the circular base 110. In other words, the central area 111 may be defined as an area of a circle having a centre at the central point of the circular base 110 and curcumference touching the closest side edge of the bulges 150. The circular central area 111 is indicated by dashed line on FIG. 5A. One of the functions of the central area 111 is to stabilize a wick cap and therefore to also stabilize the wick of the tealight (not shown in the drawing). The cup 100 also has, along the side edge of the base, a groove 140. The central area 111 may be slightly raised above the bottom edge of the groove 140, such that when one cup 100 is placed on top of another one during transport, the central area 111 of the upper cup does not press on the wick of the lower cup.

Moreover, the cup 100 has three similar bulges 150 protruding from the base 110 towards the inside of the cup 100. The height (h) of the bulges is at least 10%, or at least 15%, or at least 20%, or at least 25%, or at least 30%, or at least 35%, or at least 40%, or at least 45%, or at least 50%, or at least 55%, or at least 60%, or at least 65%, or at least 70%, or at least 75% of the height (H) of the side wall 120.

The bulges 150 are positioned around the central area 111 symmetrically, i.e. along a common circumference 152. This may mean, for example, that the common circumference 152 contains the centre of gravity of each bulge 150, or the geometrical center of base of each bulge 150, or any point of the base of each bulge 150, or any point of the highest surface of each bulge 150.

The space for the flammable mass at the bottom of the cup shall have small volume. Preferably, the bulges 150 have a volume of at least 10% of the volume of the cup from the bottom to the height (h) of the bulges (i.e. the volume of the cup up to the height (h) occupied by the bulges is decreased by at least 10% with respect to the volume of a cup having a flat bottom without bulges), or at least 15%, or at least 20%, or at least 25%, or at least 30%, or at least 35%, or at least 40%, or at least 45%, or at least 50%, or at least 55%, or at least 60%, or at least 65%, or at least 70%, or at least 75% of the volume of the cup from the bottom to the height (h) of the bulges.

The bulges 150 are formed circumferentially around the central area 111. The bulges 150 are substantially symmetrical with respect to each other and have similar shapes. The bulges 150 have flat or convex side walls, which facilitates their easy forming and flow of the flammable mass towards the bottom. The side walls of the bulges 150 are shaped such that the flammable mass flows downwards both when the tealight is set horizontally and when the tealight is inclined.

Figure 5B:
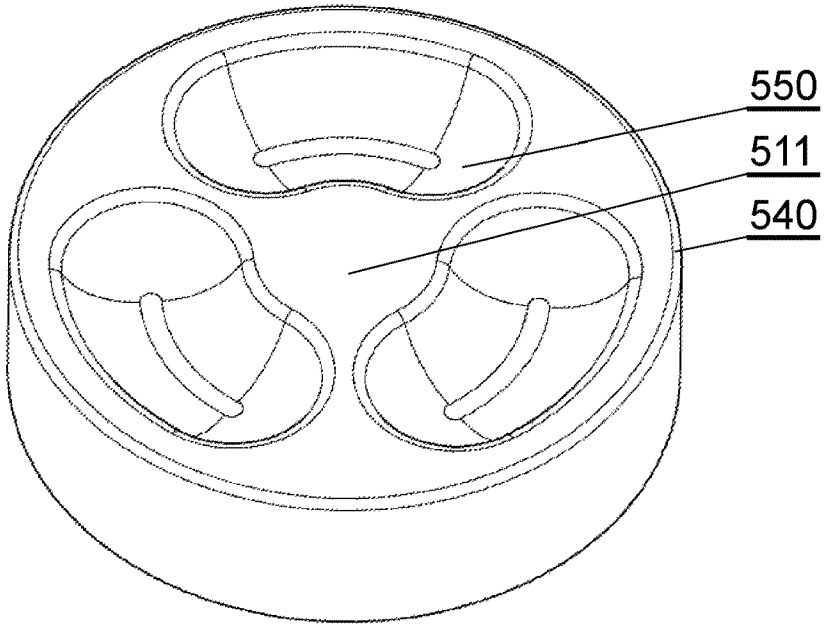
FIG. 5A, 5B show a tealight cup in a fifth embodiment having three similar bulges in a tilted top a bottom view, respectively.
Figure 5A:
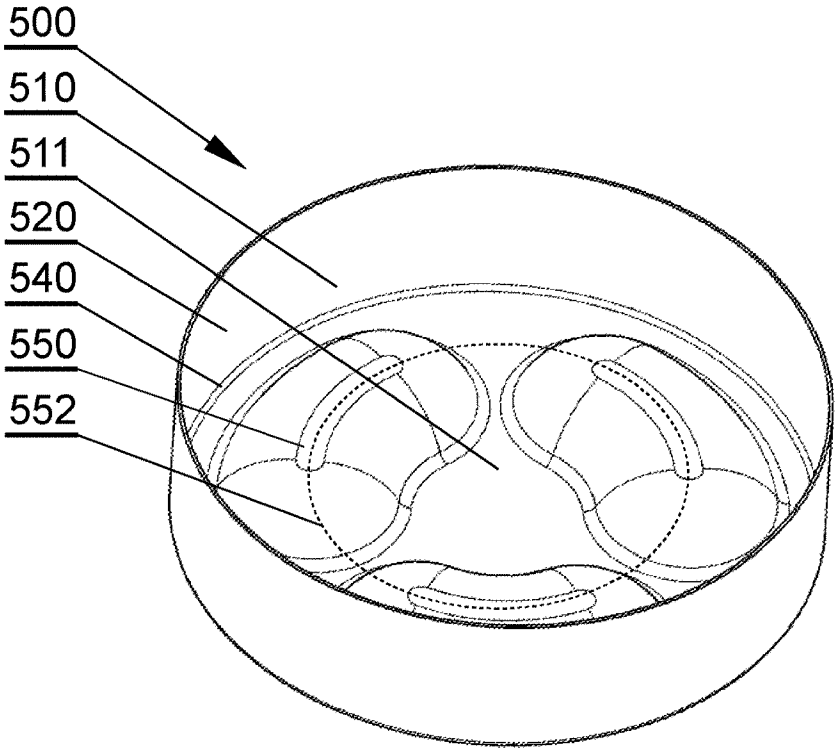

The central area 111 may have a shape dependent on the number of the bulges of the cup 100. For example, in case of three bulges 150, the central area 111 may have a shape of a circle (as shown in FIGS. 1A, 1B) or of a triangle (as shown in FIGS. 5A, 5B) with straight, concave or convex sides.

Preferably, the bulges 150 have a shape such that their side edges 151 are substantially parallel to edges of neighboring bulges and form narrow radial grooves 130, which connect the central area 111 with the circumferential groove 140 in order to facilitate flow of flammable mass from the circumferential groove 140 to the central area 111.

There are at least two bulges 150 formed in the base 110.

FIGS. 1-10 present different example embodiments of cups, whereas the reference numerals 2*xx*, 3*xx*, 4*xx*, 5*xx*, 6*xx*, 7*xx*, 8*xx*, 9*xx*, 10*xx* correspond substantially to reference numerals 1*xx*.

As shown in FIGS. 1-6, 8-10 the bulges 150-650, 850, 950, 1050 may be similar to each other. Alternatively, as shown in FIG. 7, the bulges 750, 755 may have different shapes.

As shown in FIGS. 1, 2, 3, 4, 7, between the bulges there may be formed narrow, radial grooves 130, 230, 330, 430, 730. Alternatively, as shown in FIGS. 5, 6, the bulges may have a shape such that the edges of the neighboring bulges are not parallel to each other and do not form narrow grooves.

Figure 11:
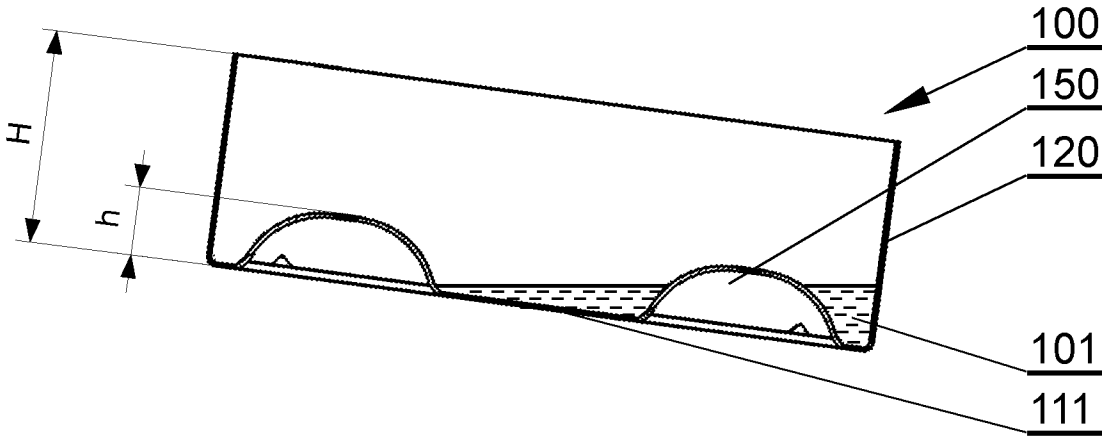
FIG. 11 shows a tealight cup of FIG. 1A-1B in an inclined position, filled with melted flammable mass, in a side cross-sectional view along line A-A.

In FIG. 11 there is shown an inclined tealight cup 100 of FIG. 1A in a cross-sectional view along the A-A line.

The cup 100 is filled with melted flammable mass 101 and is positioned in an inclined position with respect to the horizontal line. The bulges 150 efficiently prevent concentration of significant amounts of melted flammable mass at the lowest point of the cup 100. The decreased volume of the cup in the circumferential section, as a result of bulges 150 formed in the base, causes increase of the level of the melted flammable mass in the central area 111, in which the wick is located (as compared to cups without bulges), as well as concentration of lower amount of flammable mass at the lowest point of the cup.

The grooves 130 serve as channels through which the melted flammable mass may easily move towards the central area 111 of the cup 100, in which the wick is located, in order to keep the level of the liquid even. The increase of the level of the flammable mass in the central area of the cup increases the burning parameters of the wick and makes is more difficult to accidentally extinguish the wick, due to wind or as a result of shaking of the cup.

Optionally, the whole surface of the circular base 110, apart from the surface occupied by the bulges 150-1050, the grooves 130-730 and the circumferential groove 140-740 can be flat.

In an embodiment shown in FIG. 8, the circumferential groove 840 is formed by two side walls 841, 842 inclined at the same angles $\alpha$ towards a bottom plane of the surface of the base and is triangular in cross section.

In an embodiment shown in FIG. 9, the circumferential groove 940 is formed by two side walls 941, 942 inclined at different angles $\alpha$, $\beta$ towards a bottom plane of the surface of the base and is trapezoidal in cross section—it contains a flat bottom portion 943. Preferably, the outer side wall 942 is inclined at an angle $\beta$ which is greater than the angle of inclination $\alpha$ of the inner side wall 941 of the groove 940—this facilitates downwards flow of flammable mass from the side wall into the groove 940. Moreover, there may be an indent 944 at the top of the outer side wall that facilitates stacking of tealights one on top of each other, such that the outer side wall of the lower tealight fits into the indent 944.

In an embodiment shown in FIG. 10, the bulges 1050 have a flat top portion.

Therefore, the construction of the base 110 of the cup 100 with bulges 150 formed between grooves 130 around the central area 111 allows maintaining a higher level of liquid (melted flammable mass) in comparison to tealight cups known from prior art, when the cup is set in an inclined position.

The invention claimed is:

1. A tealight cup comprising:

a side wall; and a base with a flat central area and a circumferential groove around an outer edge of the base, at least two bulges positioned around the flat central area;

wherein the bulges have a height (h) of at least 10% of the height (H) of the side wall and are positioned around the flat central area circumferentially along a common circumference and have a total volume equal to at least 10% of the volume of the part of the cup from the base to the height (h) of the bulges, wherein the tealight cup is configured to hold a combustible candle and wherein the circumferential groove has an outer inclined wall, a bottom wall and an inner inclined wall, wherein the outer inclined wall is inclined at an angle greater than an angle of inclination of the inner inclined wall towards a bottom plane of a surface of the base.

* * * * *